US006667689B1

(12) United States Patent
Steffen et al.

(10) Patent No.: US 6,667,689 B1
(45) Date of Patent: Dec. 23, 2003

(54) SILVERWARE DETECTOR

(76) Inventors: Ronald W Steffen, 46 DeSoto Dr., Springfield, IL (US) 62707; Michael G. Nelson, #7 Grand Ave., Jacksonville, IL (US) 62650

( * ) Notice: Subject to any disclaimer, the term of this patent is extended or adjusted under 35 U.S.C. 154(b) by 107 days.

(21) Appl. No.: 09/961,486

(22) Filed: Sep. 24, 2001

(51) Int. Cl.[7] ..... G08B 13/14

(52) U.S. Cl. ..... 340/568.1; 340/540; 340/674; 324/228; 209/926; 209/223.1

(58) Field of Search ..... 209/4, 8, 223.1, 209/636, 926; 340/540, 568.1, 674; 324/228

(56) References Cited

U.S. PATENT DOCUMENTS

| | | | | |
|---|---|---|---|---|
| 3,149,066 A | | 9/1964 | Ross | |
| 3,926,792 A | | 12/1975 | Buford | |
| 4,367,138 A | | 1/1983 | Kustas | |
| 4,413,232 A | * | 11/1983 | Most et al. | 324/236 |
| 4,494,657 A | | 1/1985 | Oldenkamp | |
| 4,632,253 A | | 12/1986 | Stromgren et al. | |
| 4,706,818 A | | 11/1987 | Zutell et al. | |
| 4,742,339 A | | 5/1988 | Baziuk | |
| 4,782,970 A | | 11/1988 | Edwards | |
| 5,538,143 A | | 7/1996 | Pettersson | |
| 5,797,497 A | | 8/1998 | Edwards | |
| 6,129,213 A | | 10/2000 | Edwards | |
| 6,220,444 B1 | * | 4/2001 | Calhoun | 209/8 |
| 6,222,450 B1 | | 4/2001 | Clements | |
| 6,420,866 B1 | * | 7/2002 | Goldberg et al. | 209/546 X |

FOREIGN PATENT DOCUMENTS

| | | | | |
|---|---|---|---|---|
| GB | 2170737 | * | 8/1986 | 209/926 |

* cited by examiner

*Primary Examiner*—Donald P. Walsh
*Assistant Examiner*—Matthew J Kohner

(57) ABSTRACT

A device that easily fits on a refuse container and will sound an audible alarm when silverware that has been magnetized and likely hidden within other refuse falls through a sensing cavity on its way to the refuse container. This device will not trigger on any other metallic or non-metallic material due to its sensing of only passing magnetic fields. Silverware material conducive to magnetization can be easily magnetized and will retain such characteristics for a long period of time making it a practical way to differentiate silverware from other metallic refuse. The device also uses a sensing switch that activates the same audible alarm when an attempt is made to bypass the unit by removing it from the refuse container. A key switch provides security that enables alarm reset only by authorized personnel. A low battery indicator is provided by the pulsing of the audible alarm. The unit is portable, low maintenance, and requires no adjustments.

5 Claims, 5 Drawing Sheets

SILVERWARE DETECTOR

CROSS-REFERENCE TO RELATED APPLICATIONS

Not applicable.

BACKGROUND

1. Field of Invention

This invention relates to food handling equipment, specifically an apparatus that sounds an audible alarm whenever silverware is discarded with food and table refuse.

2. Description of Prior Art

Food preparers involved in restaurants, cafeterias, or catering services that provide silverware to their patrons face potential loss of such silverware during the cleanup process. Such silverware is easily mixed with food and paper refuse such that the silverware is discarded with the refuse. Such silverware is lost both accidentally as it is hidden with other refuse and sometimes deliberately by less than conscientious personnel. Silverware discarded with refuse is a serious problem in this industry.

There are numerous patents that describe devices that use magnets to attract and hold silverware as it flows with paper and food refuse down a chute or into a refuse container. These have no alarms and do not guarantee that lost silverware will be retrieved by less than conscientious personnel. Also, such devices will catch and hold silverware provided the flow and force used on the refuse is within range. Some known patents that deal with such magnetic devices with no alarms are as follows:

| U.S. Pat. No. | Issue Date | Inventor |
|---|---|---|
| 3,149,066 | Sep. 15, 1964 | Ross |
| 3,926,792 | Dec. 16, 1975 | Buford |
| 4,367,138 | Jan. 4, 1983 | Kustas |
| 4,494,657 | Jan. 22, 1985 | Oldenkamp |
| 4,706,818 | Nov. 17, 1987 | Zutell et al. |
| 4,782,970 | Nov. 8, 1988 | Edwards |
| 6,129,213 | Oct. 10, 2000 | Edwards |

Other patents exist that do employ alarms. The applicants are aware of the following references which disclose devices which are more relevant to this area of the art:

| U.S. Pat. No. | Issue Date | Inventor |
|---|---|---|
| 4,632,253 | Dec. 30, 1986 | Stromgren et al. |
| 4,742,339 | May 3, 1988 | Nelson Baziuk |
| 5,538,143 | Jul. 23, 1996 | Pettersson |
| 5,797,497 | Aug. 25, 1998 | Edwards |
| 6,222,450 | Apr. 24, 2001 | Clements |

U.S. Pat. No. 4,632,253 discloses a chute assembly with an inductive sensor and a flap door having two positions. Such an assembly appears to require a certain amount of cleaning and maintenance to keep the mechanism clean and operative. The power required to move a mechanical flap would likely make this unit less than ideal as far as being portable or having long battery life. Also, since this device senses aluminum and other nonferrous metals, adjustment is required for this device to differentiate silverware from silver paper.

U.S. Pat. No. 4,742,339 appears to overcome some of the limitations of U.S. Pat. No. 4,632,253 in that it uses an alarm to signal the presence of metal as opposed to a mechanical flap to capture such material. However, this invention is reported to trigger on all metal large enough to exceed an adjustable threshold level. Thus, adjustment is required to differentiate between tin foil and silverware. It would appear that larger metal articles whether they be tin foil or metal containers could trigger the circuit.

U.S. Pat. No. 5,538,143 appears to suffer from some of the same limitations as U.S. Pat. No. 4,632,253 in that the device has mechanical doors and a structure that does not lend itself to being easily portable or operating for long periods of time from batteries. The mechanical components appear to require maintenance and periodic cleaning. This device requires calibration to differentiate between cutlery and silver paper.

U.S. Pat. Nos. 5,797,497 and 6,222,450 also disclose metal detectors implying that they would be triggered by metal besides silverware. No differentiation is noted between ferrous and non-ferrous material implying that non-silverware metal in the refuse would likely provide a false trigger.

All current inventions fail to provide an apparatus that detects only silverware while ignoring all other metal, that is truly low maintenance, that is very portable with long battery life, that allows managers confidence that silverware is being detected independent of personnel involved, and that is very affordable due to simplicity of design.

SUMMARY

This Silverware Detector consists of a portable sensing mechanism that is installed on the top of a refuse container and can be easily moved from one refuse container to another. It senses magnetized silverware that falls into a refuse container along with other refuse. It ignores all other metal and non-metal objects.

The sensing mechanism uses magnetic field sensors to sense the falling magnetized silverware as it falls through an opening.

An electronic circuit triggered by the magnetic field sensors activates an alarm when silverware is detected.

OBJECTS AND ADVANTAGES

Accordingly, several objects and advantages of our invention are here provided. Our invention has the ability to differentiate between the silverware of interest and other metal objects be they ferrous or non-ferrous. Only magnetized silverware triggers the alarm providing for a very consistent and reliable means of detection. Also, our invention is mechanically simple with no moving parts that require cleaning or adjustment. Accordingly, our invention is light weight allowing easy movement from refuse container to refuse container. Our invention uses little electrical power allowing long operation on a set of batteries further enforcing our claim of portable operation with little periodic maintenance. The presence of a latched audible alarm allows security features that prevent unconscientious employees from ignoring silverware falling into the refuse container.

Further objects and advantages of our invention will become apparent from a consideration of the drawings and ensuing description.

DRAWINGS

REFERENCE NUMERALS IN DRAWINGS

| | | | |
|---|---|---|---|
| 18 | silverware detector | 20 | funnel assembly |
| 22 | refuse container | 24 | front magnetic field sensor |
| 26a/26b | flux collector | 28 | rear magnetic field sensor |
| 30 | Hall Effect IC | 32 | electronic monitor circuit |
| 34 | position sensor | 36 | batteries |
| 38 | power key switch | 40 | audible alarm |
| 42 | silverware | 44 | rear magnetic field sensor interface |
| 46 | front magnetic field sensor interface | 48 | position sensor input |
| 50 | alarm output | 52 | switch power input |
| 54 | rear channel amplifier | 56 | front channel amplifier |
| 58 | threshold detector | 60 | bi-stable latch |
| 62 | reset signal line | 64 | alarm driver |
| 66 | power supply | 68 | low battery oscillator |
| 70 | max peak signal line | 72 | min peak signal line |
| 74 | low battery signal line | 76 | voltage reference circuit |

DESCRIPTION

Figure 1:
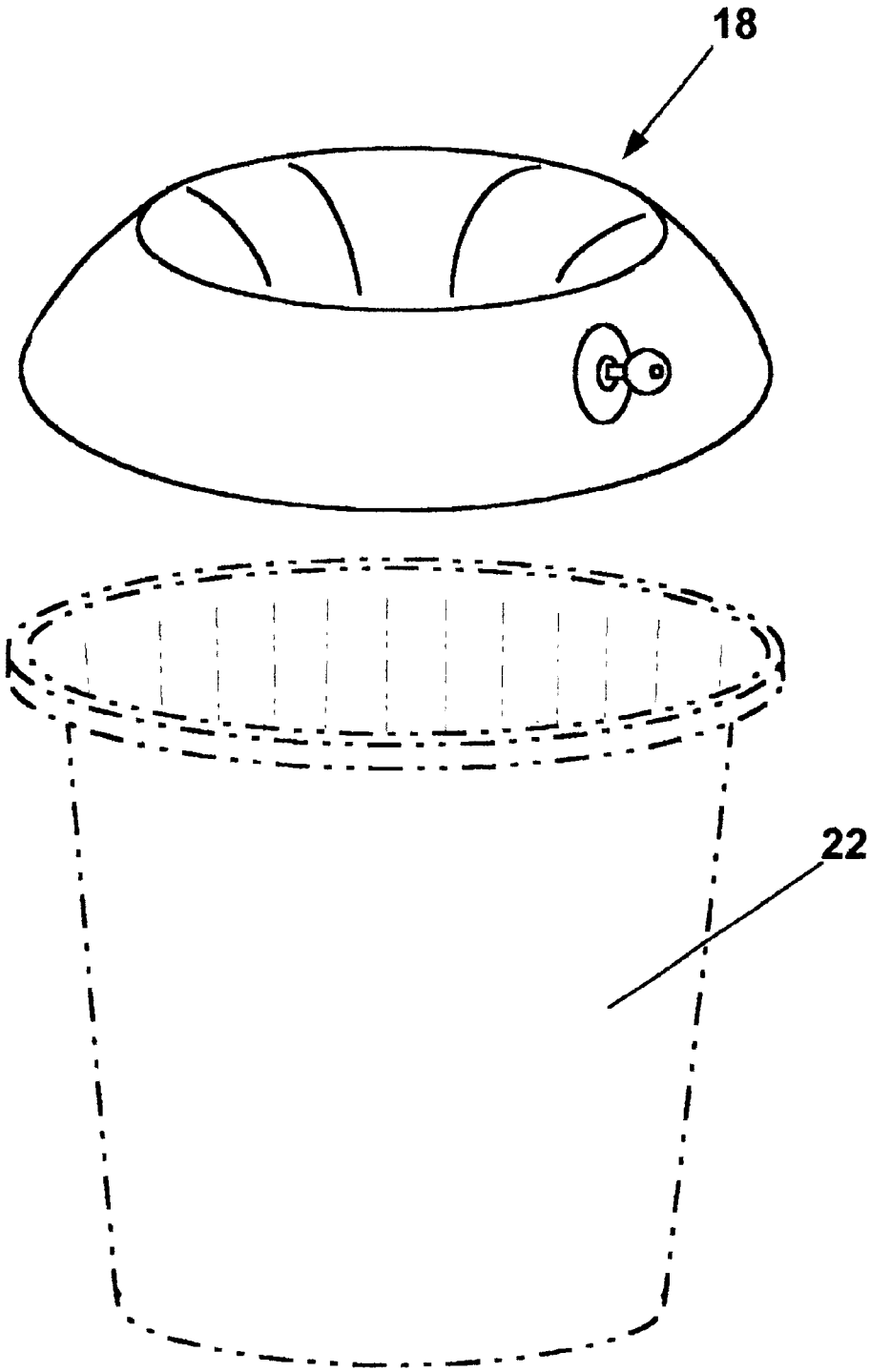
FIG. 1 is an overview drawing showing the invention as it would appear to a user.

FIG. 1 depicts a specific embodiment of silverware detector 18 as it appears lifted off of its final mounting location on the top of refuse container 22.

Figure 2:
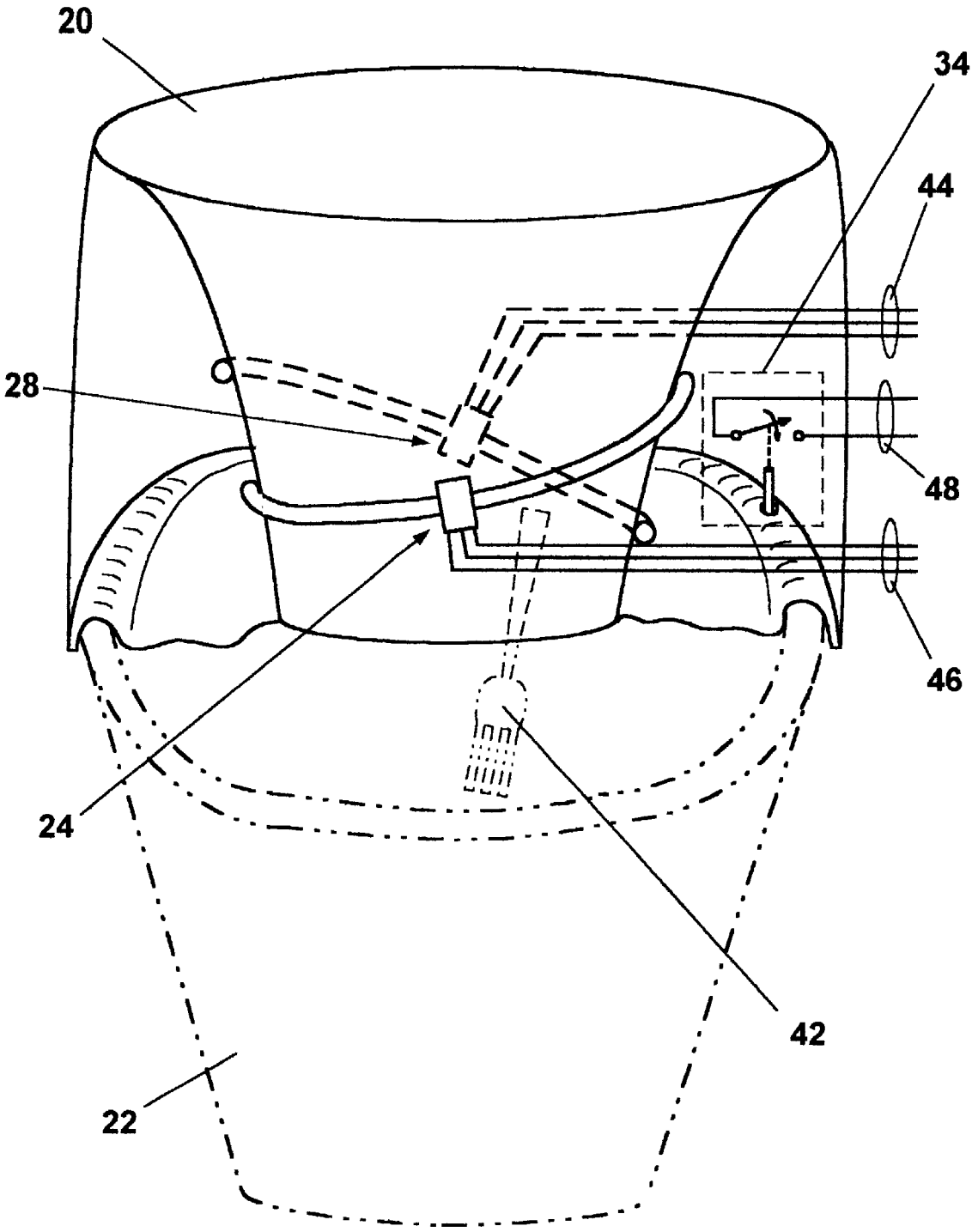
FIG. 2 is a cut-away view showing only the sensor positions in the main enclosure.

FIG. 2 shows more detailed information regarding the sensing components of silverware detector 18. Funnel assembly 20 contains an integral circular conduit for collecting and channeling refuse into refuse container 22. Funnel assembly 20 also provides for refuse container sealing by covering the top of refuse container 22 to prevent easy access to the inside of the container without first removing funnel assembly 20 from refuse container 22. Silverware 42 shows the travel path of silverware and also refuse as it flows through the circular funnel into refuse container 22. Funnel assembly 20 also houses front magnetic field sensor 24, rear magnetic field sensor 28, and position sensor 34. In addition funnel assembly 20 houses and supports all components of silver detector 18 shown in FIG. 1. Funnel assembly 20 is made from a non-magnetic material such as a moldable plastic.

Figure 3:
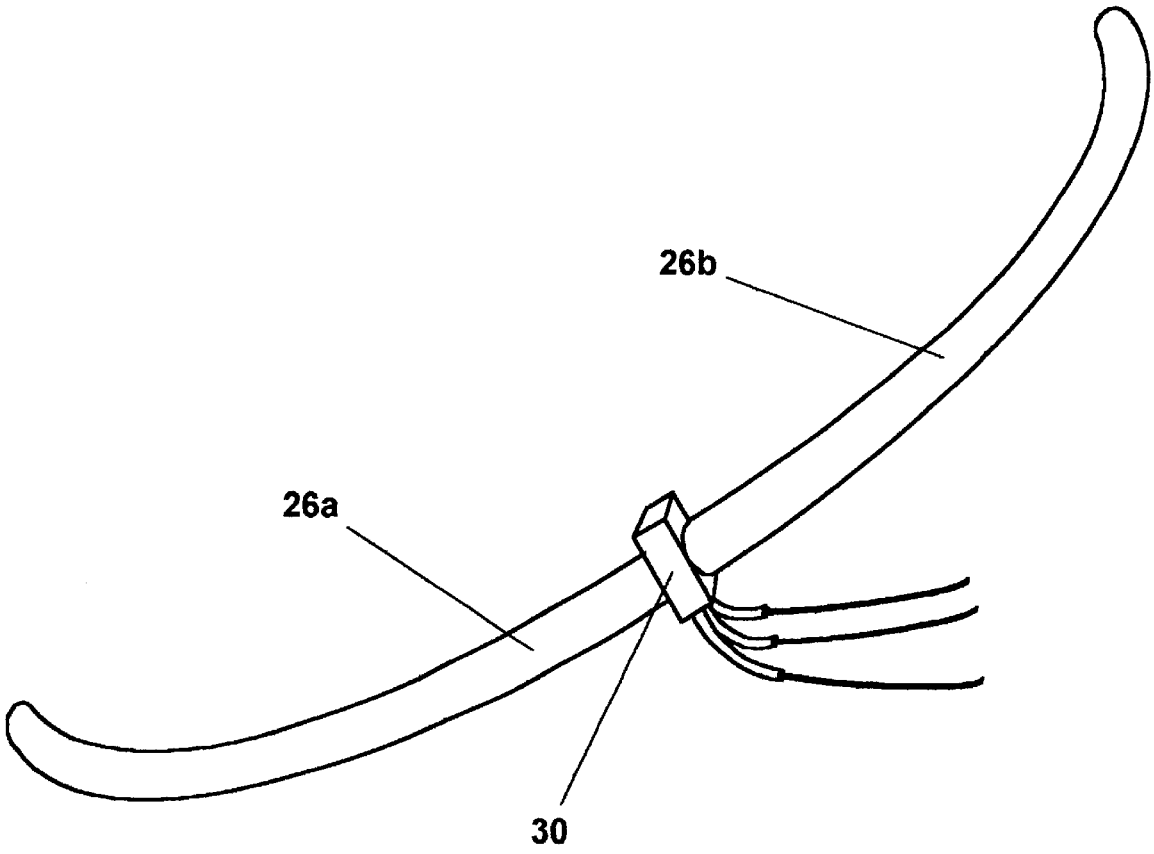
FIG. 3 is a more detailed drawing of one of the magnetic field sensors showing a linear Hall Effect integrated circuit and its related flux collectors.

FIG. 3 shows more detail regarding magnetic field sensor 24 and 28. Magnetic field sensors 24 and 28 are assemblies each consisting of a Hall Effect IC 30 and a flux collector 26*a* and a flux collector 26*b*. In this embodiment, Hall Effect IC 30 is a linear integrated circuit identified specifically as Allegro A3515EUA. Hall Effect IC 30 is sandwiched between flux collector 26*a* and flux collector 26*b* such that its sensing element is in the center of the gap formed by the two flux collectors 26*a* and 26*b*. Flux collectors 26*a* and 26*b* are made from ferrous material having low reluctance to magnetic flux.

Again referring to FIG. 2, front magnetic field sensor 24 and rear magnetic field sensor 28 are mounted on opposite sides of funnel assembly 20 refuse opening. Both magnetic field sensors 24 and 28 are mounted on the outside of the refuse funnel wall protected from the flow of refuse. A front magnetic field sensor interface 46 provides power to front magnetic field sensor 24 as well as transmits an analog signal from front magnetic field sensor 24. A rear magnetic field sensor interface 44 likewise does the same for rear magnetic field sensor 28. Front magnetic field sensor 24 and rear magnetic field sensor 28 are arranged such that their axial centers are approaching 90 degrees to each other when referencing the front view of FIG. 2. Funnel assembly 20 height restrictions may prevent an ideal 90 degree angle between the two magnetic field sensors. When viewed from the top, front magnetic field sensor 24 and rear magnetic field sensor 28 each wrap approximately half way around the circular funnel.

FIG. 2 also shows position sensor 34 mounted on funnel assembly 20 such that the electrical switch associated with position sensor 34 opens its contacts when funnel assembly 20 is installed on refuse container 22. Alternatively, this switch closes its contacts when funnel assembly 20 is removed from refuse container 22. A position sensor input 48 serves as an interface to position sensor 34 conveying specifically its switch contact state to an electronic monitor circuit 32 shown in FIG. 4.

Figure 4:
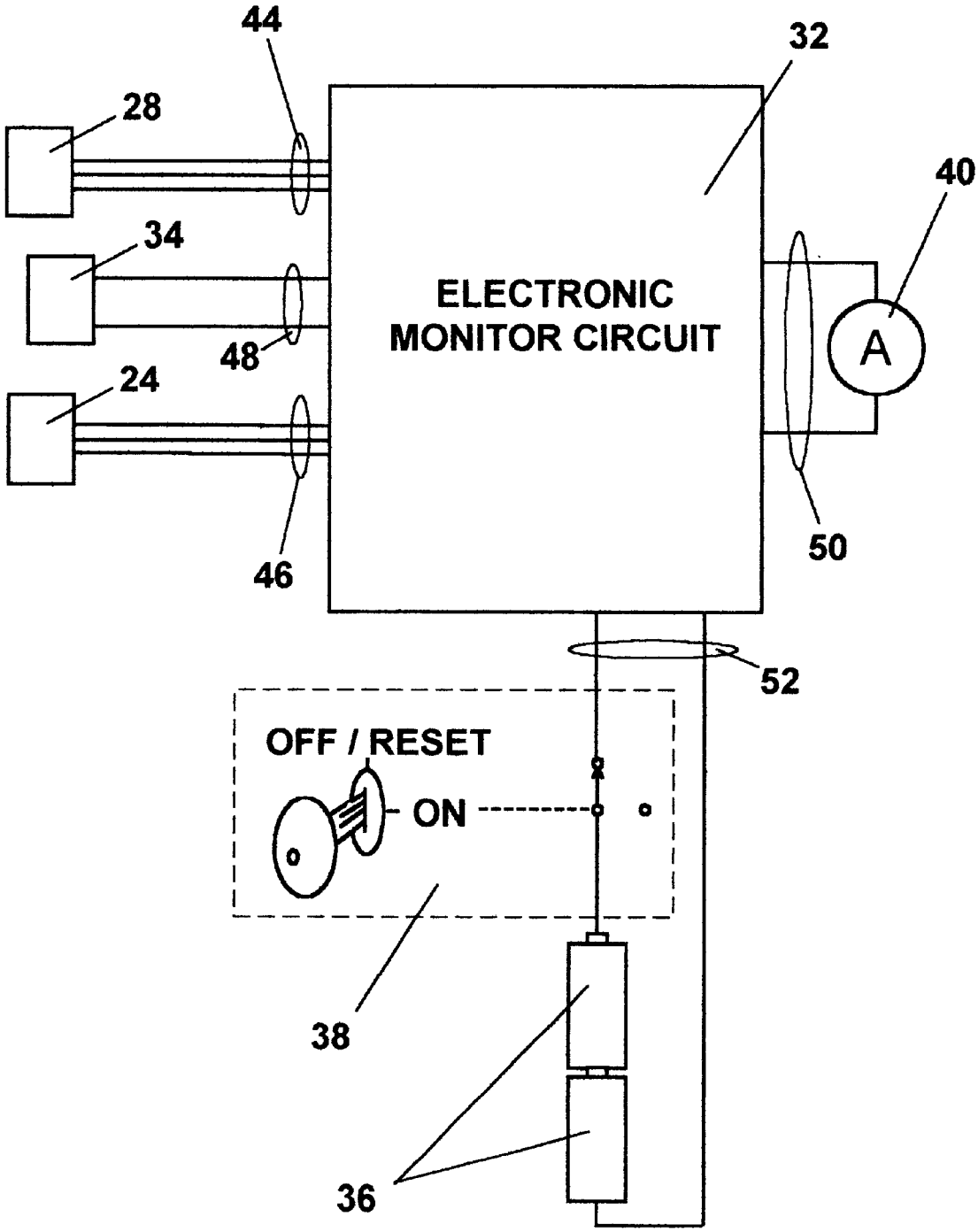
FIG. 4 is a block and symbol diagram showing the basic electrical and electromechanical components of the invention.

FIG. 4 shows electronic monitor circuit 32 interfacing to front magnetic sensor 24 through front magnetic sensor interface 46. Similarly, for back magnetic sensor 28 and for position sensor 34. An audible alarm 40 interfaces to electronic monitor circuit 32 through an alarm output 50. Audible alarm 40 is a low current piezoelectric alarm. Batteries 36 and a power key switch 38 provide power to electronic monitor circuit 32 through a switch power input 52. Specifically for this embodiment, batteries 36 are four "D" cells wired in a combination series—parallel configuration to provide a nominal 3.0 volts. Power is switched on and off using power key switch 38. Power key switch 38 has two positions—off and on. Key switch 38 includes a key that is removable in both positions.

Figure 5:
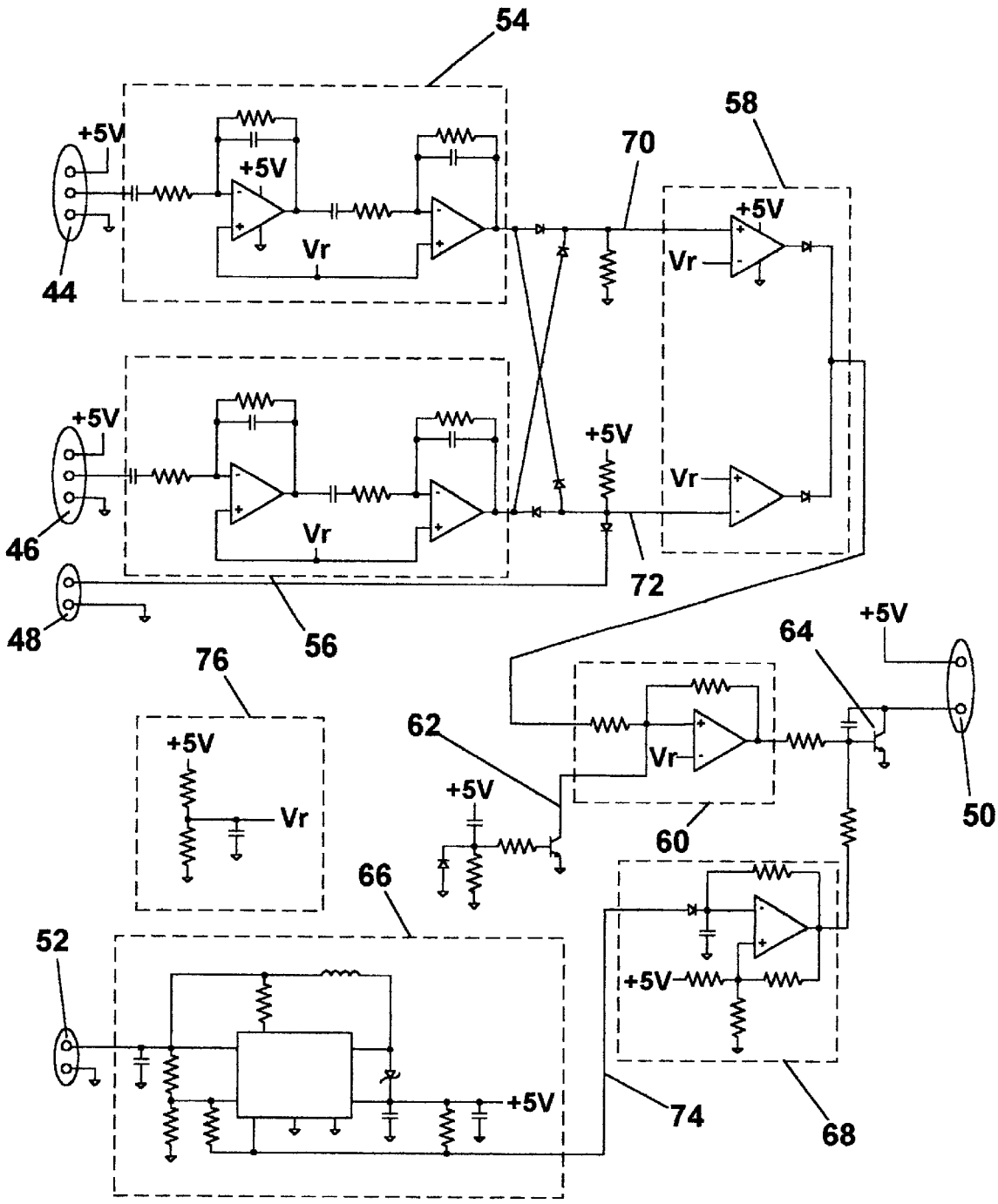
FIG. 5 is a schematic of the circuitry contained in electronic monitor circuit 32 shown as a block diagram in FIG. 4.

FIG. 5 shows in schematic format the details contained in electronic monitor circuit 32 shown in FIG. 4. Two amplifier channels referred to as a rear channel amplifier 54 and a front channel amplifier 56 are associated with rear magnetic field sensor 28 and front magnetic field sensor 24 respectively. Each amplifier consists of two operational amplifiers provided in this specific embodiment by a LM324A quad operational amplifier integrated circuit package. Amplifiers 54 and 56 each amplify the small signals from their respective magnetic field sensor. Each amplifier has a frequency bandpass that corresponds with the expected velocity range of silverware falling through funnel assembly 20.

Using conventional diode circuits, a max peak signal line 70 follows the maximum DC voltage signal coming from rear channel amplifier 54 and front channel amplifier 56. Likewise, a min peak signal line 72 follows the minimum DC voltage signal from the two amplifier channels. Each of these two signals is fed into a threshold detector 58. A reference voltage generated by a voltage reference circuit 76 is used as the reference threshold for threshold detector 58. Threshold detector 58 in this specific embodiment is built around two operational amplifiers from the LM324 quad integrated circuit package. When the voltage on max peak signal line 70 exceeds the reference voltage, a bi-stable latch 60 is set. Likewise, when the voltage on min peak signal line 72 drops below the reference voltage, bi-stable latch 60 is also set.

Latch 60 in this specific embodiment is built around one operational amplifier from the LM324 quad integrated circuit package.

Min peak signal line 72 can also be biased low by position sensor 34 closing its contacts. This takes place when funnel assembly 20 is removed from refuse container 22. This biasing of min peak signal line 72 will also cause threshold detector 58 to set bi-stable latch 60.

Bi-stable latch 60, when set, causes alarm driver 64 to energize audible alarm 40. Driver 64 is a NPN bi-polar transistor. The only way to reset bi-stable latch 60 is to power silverware detector 18 off using power key switch 38 shown in FIG. 4. Upon power on of the unit, a reset signal line 62 insures that bi-stable latch 60 is in the reset state—that is, alarm driver 64 and audible alarm 40 off.

Power applied to the circuitry of electronic monitor circuit 32 is regulated by a power supply 66. Power supply 66 in this specific embodiment is a switching power supply built around a Linear Technology LT1173CN8-5 integrated circuit. Power supply 66 maintains its output voltage near 5.0V as the battery input voltage available at a switched power input 52 varies. Power supply 66 also drives a low battery signal line 74 such that when in a low battery condition will enable a low battery oscillator 68. This oscillator in this specific embodiment is built around one operation amplifier from the LM324 quad integrated circuit package. Oscillator 68 will drive alarm driver 64 such that audible alarm 40 will pulse when a low battery condition exists.

OPERATION—FIGS. 2, 4, 5

Silverware 42 mixed with other refuse is directed to refuse container 22 via funnel assembly 20. The magnetic field associated with silverware 42 having been previously magnetized causes a signal change in one or both magnetic field sensors 28 and 24. The near orthogonal structure of magnetic field sensors 28 and 24 each with its extended flux collectors 26*a* and 26*b* is such that silverware 40 can not fall past magnetic field sensor 24 or magnetic field sensor 28 without producing a perturbation in one of the sensors. When silverware 40 is falling in such a position and direction to produce almost no flux change in one of the magnetic field sensors due to symmetry of the flux collectors 26*a* and 26*b*, the opposite magnetic field sensor with its near orthogonal set of flux collectors will be in optimum position to sense the passing magnetic field. Hall Effect IC 30 in both magnetic field sensor 28 and magnetic field sensor 24, is a linear Hall Effect device that is biased such that the output signal line is at ½ of its supply voltage with no magnetic field. Changes in magnetic flux density in magnetic field sensor 28 and magnetic field sensor 24 due to the passage of magnetized silverware will cause a perturbation in the output voltage signal of these magnetic field sensors. All other material not magnetized, whether metal or non-metal, falling through funnel assembly 20 will not cause output voltage signal perturbations.

The two voltage signals from magnetic field sensor 28 and magnetic field sensor 24 are separately amplified through two independent amplifier channels, rear channel amplifier 54 and front channel amplifier 56. The bandpass of these amplifiers is such that only signal perturbations in the frequency range corresponding to silverware 42 passing through the funnel assembly 20 are amplified. Voltage perturbation signals having frequencies below and above the bandpass frequency range are not amplified to the same level.

Diodes couple the outputs from rear channel amplifier 54 and front channel amplifier 56 to threshold detector 58. Amplified signal perturbations will cause amplifier output voltages above and below the bias voltage of the amplifiers. The bias voltage is generated by voltage reference circuit 76. Max peak signal line 70 will show the maximum peak of the perturbation above the reference voltage while min peak signal line 72 will show the minimum peak of the perturbation below the reference voltage. Either a perturbation from amplifier 54 or amplifier 56 resulting in a voltage above the reference voltage or a perturbation resulting in a voltage below the reference voltage will trigger threshold detector 58.

When a signal perturbation causes threshold detector 58 to trigger, bi-stable latch 60 is set. This set state biases alarm driver 64 on, which in turn activates audible alarm 40 through alarm output 50. Bi-stable latch 60 remains set until silverware detector 18 is powered off.

Additionally, removing funnel assembly 20 from the refuse container 22 will cause position sensor 34 to close its contacts. Position sensor input 48 in turn causes min peak signal line 72 to be biased such that threshold detector 58 will set bi-stable latch 60. This drives alarm driver 64 on, which in turn causes audible alarm 40 to sound continuously.

When the unit is powered on, reset signal line 62 insures that bi-stable latch 60 is initialized in the reset state—that is, alarm driver 64 off resulting in audible alarm 40 off. Power key switch 38 works in conjunction with this circuitry during power on to provide an alarm reset function.

Power supply 66 provides regulated voltage to all circuitry in electronic monitor circuit 32. When the battery voltage approaches a low level where power supply 66 can no longer provide voltage regulation, low battery signal line 74 enables low battery oscillator 68 which in turn cycles alarm driver 64 on and off causing the audible alarm 40 to pulse on and off. This signals the operator of a low battery voltage condition.

CONCLUSION

Thus this invention provides a very portable, low maintenance, and cost effective device that will detect only silverware that has been magnetized allowing all other refuse whether metallic or otherwise to pass with no false triggering.

Although the above description contains many specific implementations, these should not be constructed as limitations on the scope of the invention, but rather as an exemplification of one preferred embodiment. Other variations are possible. For example, the sensing cavity need not be circular. Rectangular openings as well as other variations are possible. The flux collector design need not be made from round stock but can use other shape variations. Such collectors need not necessarily wrap around the sensing cavity nor be orthogonal to each other. If the sensing cavity is small enough, it is possible that only one assembly of sensor and flux collectors would de required. Also, other variations in circuitry can be used to sense perturbations in the voltage from the linear magnetic sensor. The alarm can be momentary not requiring operator intervention for reset. Also, reset could be achieved through other methods other than the key switch shown such as a momentary switch or a keypad. Other alarms could be employed beside the audible alarm indicated.

We claim:

1. A silverware detector for detecting magnetized silverware in refuse material consisting of both metallic and non-metallic objects being conveyed along a predetermined path to a refuse container, comprising:

(a) a funnel assembly means for channeling refuse into a refuse container;

(b) a magnetic field sensor means for providing a response to magnetized silverware passing through said funnel assembly means in all possible orientations and with all velocities associated with free-falling refuse material;

(c) electronic circuit monitor means connected to said magnetic field sensor means and responsive to said magnetic field sensor means in providing an alarm output when said magnetic field sensor means' response exceeds a predetermined level;

(d) alarm means that is activated by said alarm output from said electronic circuit monitor means that provides a warning when said magnetized silverware is detected.

2. The silverware detector of claim 1, further including:

(a) a refuse container sealing means for restricting access to the inside of the said refuse container when said refuse container sealing means is installed on said refuse container;

(b) a position sensor means for detecting the removal of the said refuse container sealing means from said refuse container and providing a response;

(c) electronic circuit monitor means connected to and responsive to said position sensor means in providing an alarm output when said refuse container sealing means is removed from said refuse container;

(d) alarm means activated from said alarm output from said electronic circuit monitor means such that said alarm provides a continuous warning when said refuse container sealing means is moved from said refuse container;

(e) alarm reset means that restores said electronic circuit monitor means to a monitor state with said output alarm output temporarily off by the action of authorized personnel.

3. The silverware detector of claim 1 wherein said alarm output once turned on stays on until reset.

4. The silverware detector of claim 3, further including alarm reset means that restores said electronic circuit monitor means to a monitor state with said output alarm output temporarily off by the action of authorized personnel using a key switch means.

5. The silverware detector of claim 1, further including:

(a) electronic circuit monitor means for determining a low battery voltage condition and providing an alarm output when said voltage falls below a predetermined level;

(b) alarm means activated from said alarm output from said electronic circuit monitor means such that said alarm provides a continuous warning when said battery voltage is below said predetermined level.

* * * * *